US006722372B1

(12) United States Patent
Cantrell

(10) Patent No.: US 6,722,372 B1
(45) Date of Patent: Apr. 20, 2004

(54) WRAPPER FOR SMOKING ARTICLE

(75) Inventor: Daniel V. Cantrell, Macon, GA (US)

(73) Assignee: Brown & Williamson Tobacco Corporation, Louisville, KY (US)

( * ) Notice: Subject to any disclaimer, the term of this patent is extended or adjusted under 35 U.S.C. 154(b) by 0 days.

(21) Appl. No.: 09/619,793

(22) Filed: Jul. 20, 2000

(51) Int. Cl.[7] ..... A24D 1/02
(52) U.S. Cl. ..... 131/365; 131/360; 162/139
(58) Field of Search ..... 131/365, 360, 131/359; 162/139

(56) References Cited

U.S. PATENT DOCUMENTS

| | | | | | |
|---|---|---|---|---|---|
| 246,117 | A | | 8/1881 | Funke | |
| 4,225,636 | A | * | 9/1980 | Cline et al. | 427/243 |
| 4,231,377 | A | | 11/1980 | Cline et al. | |
| 4,548,677 | A | * | 10/1985 | Schneider et al. | 162/139 |
| 4,984,589 | A | | 1/1991 | Riedesser | |
| 5,141,007 | A | | 8/1992 | Raker et al. | |
| 5,172,708 | A | | 12/1992 | Drewett et al. | |
| 5,220,930 | A | | 6/1993 | Gentry | |
| 5,348,027 | A | | 9/1994 | Barnes et al. | |
| 5,439,010 | A | * | 8/1995 | Ross | 131/332 |
| 5,494,055 | A | | 2/1996 | Noe et al. | |
| 5,617,881 | A | | 4/1997 | Kossmehl et al. | |
| 5,692,525 | A | * | 12/1997 | Counts et al. | 131/194 |

* cited by examiner

*Primary Examiner*—Dionne A. Walls
(74) *Attorney, Agent, or Firm*—Charles G. Lamb; John F. Salazar; Middleton Reutlinger

(57) ABSTRACT

A smoking article particularly to eliminate spotting or staining and provide good smoke quality includes a double wrap smoking article which includes an outer wrap of a conventional cigarette paper and an inner wrap which is comprised of from about 55 to 85% wood fibers and 15 to 45% flax fibers, a basis weight of 12–15 gm/M$^2$ and a porosity of 200 to 160,000 Coresta or greater.

6 Claims, No Drawings

WRAPPER FOR SMOKING ARTICLE

BACKGROUND OF THE INVENTION

The present invention is directed to a wrapper for a smoking article and particularly an inner wrap for a smoking article to reduce spotting.

In the manufacturing of smoking articles, and particularly cigarettes, in the last few years there has been a considerable amount of detail paid to the wrappers for use in encasing a tobacco rod or other smokeable materials. There has been considerable concern for the reduction of secondary or sidestream smoke which is a by-product of the combustion of a smoking article as well as selected additives to reduce fire propensity which are formulated into the cigarette wrapper. Moreover, there have been suggestions of circumscribing tobacco rods with a plurality of wrappers wherein each wrapper has certain additives therein to reduce this sidestream smoke as well as fire propensity. However, in many cases the types of additives that have been added to the cigarette wrapping papers have created off-taste or reduced the smoke quality or created undesirable appearances in the smoking article.

For example, U.S. Pat. No. 4,225,636 and U.S. Pat. No. 4,505,282 teach taste improvement in a smoking article by using a carbon inner liner in a smoking article. And, U.S. Pat. No. 5,172,708 teaches an improvement in the yellow spotting or staining with a double wrap cigarette paper wherein the inner wrap is comprised of a mixture of wood fibers, specifically pine and birch.

Spotting of the exterior wrapper on cigarettes occurs over time by either the tobacco pigment and/or flavor/casing additives transferring to the exterior layer of paper. Spotting is accelerated by transportation/storage temperatures above 90° F. and high humidity. Temperatures of 120–130° F. have been recorded during product transit from manufacturer to the final end market, especially during summer months.

SUMMARY OF THE INVENTION

It is an object of the present invention to provide a wrapper that eliminates spotting of the exterior paper wrapper during transportation/storage of the smoking article.

It is another object of the present invention to provide a double wrap smoking article wherein the inner wrap improves the taste quality of the smoking article and simultaneously reduces spotting or staining.

It is a further object of the present invention to provide an inner wrap for a smoking article wherein the inner wrap includes at least 50% by weight of wood fibers and less than 50% by weight of flax. Preferably, wood fibers would make up from 55 to 85% by weight of the inner wrap fiber matrix with the remainder being flax. It has been found that in manufacturing an inner wrap for the spotting/staining via a double wrap smoking article that the lower the basis weight of the paper and the higher the porosity was desirable. For example, inner wrap papers having a basis weight of less than 15 gm/M$^2$ decreases irritation from smoke as the basis weight is lowered. Moreover, inner wrap papers having a basis weight of 12 gm/M$^2$ demonstrated a lower irritation than an inner wrap having a basis weight of 15 gm/M$^2$. And, inner wraps of a mixture of wood and flax where the fiber ratio was approximately 30% flax and 70% wood have been found to be better tasting with less smoke irritation in comparison with inner wraps comprised of a mixture of 50% abaca and 50% wood.

Double wrapped cigarettes using two conventional papers, made with flax or wood, or a combination of both fibers, having normal burn additives (0.3–2.5% citrates and 20–30% chalk), and normal porosity (10–120 Coresta) have been used in some products marketed in the past and are to some extent, still practiced today. The problem with using two layers of conventional papers is two-fold. First, the taste is negatively affected, by an increase in irritation, dryness, and overall papery character; and secondly, the smoke chemistry is changed by a substantial Increase in mainstream vapor phase smoke components.

One of the unique characteristics of the inner wrap of the present invention is that it is made to have a porosity that would be normally associated with porous filter plug wraps (5,000 to 160,000 Coresta). The advantage of using a high porosity inner wrap is that much of the vapor phase components in the mainstream smoke are not elevated.

DETAILED DESCRIPTION OF THE PREFERRED EMBODIMENTS

In the preparation of smoking articles of the present invention, a double-wrap paper wrapper is wrapped around a tobacco rod wherein the outer wrap is a paper wrap which includes either 100% of flax fiber or 100% wood fiber or a mix of flax and wood fibers along with other-additives, such as calcium carbonate, and is at a basis weight of about 20–25 gm/M$^2$ with a porosity in the neighborhood of 25–50 Coresta units with other additives which may include burn additives, and the like. The inner wrap is made up of from 55 to 85% percent, by weight, of wood fibers which includes soft wood, such as pine, and hard woods such as eucalyptus. Moreover, the inner wrap includes from about 15 to 45% by weight of flax. Preferably, the wood fiber is about 70% by weight and the flax is about 30% by weight. Generally, the flax is selected from the group consisting of bast flax fiber and shive flax fiber wherein the bast flax fiber is from 50 to 90% and the shive flax fibers is from 10 to 50%. Also, the inner wrap has a preferred basis weight of from 12 to 15 gm/M$^2$ and a porosity of from about 200 to 160,000 Coresta units. The two wrappers then circumscribe a tobacco rod wherein the tobacco rod may be prepared from burley, flue cured, oriental, reconstituted tobacco, stems, or any combination in order to obtain a smokable product.

The following examples are given to illustrate the present invention.

EXAMPLES 1–11

Smoking articles were prepared using a double wrap paper wrapper on a tobacco rod wherein the outer wrap is a paper wrap which includes 100% of flax fiber, 28% calcium carbonate, 25 gm/M$^2$ basis weight, 50 Coresta units and 0.6% mixed citrates of sodium and potassium. The tobacco rod is made up of 30% burley, 40% flue cured, 10% oriental, 15% reconstituted, and 5% stem. A description of the inner wrap formulations examined were:

- Examples 1–3 used approximately 50% abaca and 50% wood fibers, at basis weights of 16, 13 and 12 gm/M$^2$.
- Example 4 used approximately ⅓ wood, ⅓ abaca and ⅓ flax fibers at a basis weight of 13 gm/M$^2$.
- Examples 5–7 used approximately 40% abaca, 40% wood and 20% flax fibers, at basis weights of 14, 13, and 12 gm/M$^2$.
- Examples 8 and 9 used 100% wood fiber at basis weights of 13 and 12 gm/M$^2$.
- Example 10 used approximately 70% wood and 30% flax at a basis weight of 12 gm/M$^2$.

Example 11 used the inner wrap of Example 10, but used a lighter weight (21 gm/$M^2$) outer wrap.

In sensory testing, the different examples shown above, exhibited different smoking characteristics depending upon the basis weight of the inner wrap and the type of fiber(s) in the inner wrap. Example 11 clearly illustrates how a paper's basis weight affects the overall smoking properties. Table I sets forth some of the different smoking characteristics of the Examples.

TABLE I

| EXAMPLE | INNER WRAP FIBER FORMULA | INNER WRAP BASIS WT. (gm/$M^2$) | SMOKE SENSORY PANEL RESULTS IRRITATION | | SMOKE OFF-TASTE QUALITY |
|---|---|---|---|---|---|
| 1 | 50 abaca/ 50 wood | 15 | 8 | 8 | Very poor |
| 2 | 50 abaca/ 50 wood | 13 | 6 | 8 | Very poor |
| 3 | 50 abaca/ 50 wood | 12 | 5 | 8 | Poor |
| 4 | 33 abaca/ 33 wood/ 33 flax | 13 | 4 | 6 | FAIR |
| 5 | 40 abaca/ 40 wood/ 20 flax | 14 | 6 | 7 | Poor |
| 6 | 40 abaca/ 40 wood/ 20 flax | 13 | 5 | 7 | Poor |
| 7 | 40 abaca/ 40 wood/ 20 flax | 12 | 4 | 7 | FAIR |
| 8 | 100% wood | 13 | 4 | 3 | Good |
| 9 | 100% wood | 12 | 3 | 3 | Good |
| 10 | 70 wood/ 30 flax | 12 | 2 | 2 | Very good |
| 11 | 70 wood/ 30 flax | 12 | 1 | 0 | Excellent |

Key to Irritation and Off-Taste Ratings: (0 = none, 1–3 = low, 4–6 = moderate, 7–9 = high amount).

It can be seen from the above examples that Examples 1–7 show a strong negative correlation with abaca content and smoke quality, driven by off taste. There is also a nice correlation with a reduction in irritation and improvement in smoke quality with lower basis weight of the inner wrap. Also, strongly correlated with better smoking properties are the use of standard cigarette paper fibers (wood and flax) as the fibers of choice for the inner wrap. Example 11 clearly demonstrates the combination of using the inner wrap of choice and a lower basis weight outer wrap.

It is to be understood that the invention is not to be limited to the specific Examples shown, as the parameter set forth in the Examples may be varied by appropriate changes or different levels of fibers used in the inner wrap.

What is claimed is:

1. A smoking article comprising:

an outer wrap of a cellulosic fiber material circumscribing an inner wrap, said inner wrap comprising from 55 to 85% by weight of wood fibers and from 15 to 45% by weight of flax, said inner wrap circumscribing a tobacco rod.

2. The smoking article of claim 1 wherein said wood fiber is about 70% by weight and said flax is about 30% by weight.

3. The smoking article of claim 1 wherein said wood fiber is selected from the group consisting of soft woods and hard woods.

4. The smoking article of claim 3, said soft wood being pine.

5. The smoking article of claim 3, said hard wood being eucalyptus.

6. The smoking article of claim 1 wherein said. flax is selected from the group consisting of 50–90% bast flax fibers and 10–50% shive flax fibers.

* * * * *